United States Patent [19]

Wittern

[11] 3,989,163

[45] Nov. 2, 1976

[54] VENDING APPARATUS WITH HELICAL DISCHARGE MEMBER

[75] Inventor: Francis A. Wittern, Des Moines, Iowa

[73] Assignee: Fawn Engineering Co., Des Moines, Iowa

[22] Filed: Apr. 28, 1975

[21] Appl. No.: 572,061

[52] U.S. Cl. ..... 221/75; 221/281

[51] Int. Cl.[2] ..... G07F 11/36

[58] Field of Search ..... 221/75, 222, 241, 242, 221/281

[56] References Cited

UNITED STATES PATENTS

| | | | |
|---|---|---|---|
| 2,221,016 | 11/1940 | Wood | 221/281 X |
| 3,000,408 | 9/1961 | Vischer | 221/222 X |
| 3,335,907 | 8/1967 | Holstein et al. | 221/75 X |
| 3,512,679 | 5/1970 | Stoltz | 221/241 X |
| 3,601,281 | 8/1971 | Schlaf | 221/155 X |
| 3,828,971 | 8/1974 | Offutt et al. | 221/75 |
| 3,861,561 | 1/1975 | Wittern et al. | 221/75 |

*Primary Examiner*—Robert B. Reeves
*Assistant Examiner*—Francis J. Bartuska
*Attorney, Agent, or Firm*—Henderson, Strom & Sturm

[57] ABSTRACT

A vending apparatus of a type utilizing a selectively rotatable helical member. The helical member is connected at one end to an annular plate having gear teeth around the inner periphery thereof. A drive gear is disposed within the annular plate and is in operative engagement with the teeth on the inner periphery of the annular plate. The drive gear and thereby the annular plate and helix is driven ultimately by an electric motor. Once the motor is turned on the helical member will rotate one-half of a revolution before being switched off by a switching device. A vertical divider is disposed within the helical member and supports the helical member along the top thereof. A portion of the helical member is aligned along the longitudinal axis of the helix and this portion is connected to the vertical divider for stabilizing and supporting the helical member as it rotates. A plurality of such vending units are stacked on top of one another and are slidable into and out from a cabinet housing. Structure is also provided for providing side access for loading items into the helical member on each side of the vertical divider.

47 Claims, 9 Drawing Figures

VENDING APPARATUS WITH HELICAL DISCHARGE MEMBER

BACKGROUND OF THE INVENTION

The present invention relates generaly to vending machines and more particularly to a vending machine having a helical article dispensing member.

One of the most increasingly popular types of vending machines are the ones which have a helical member disposed in a vending chamber whereby the articles are disposed within the loops of the helix and are moved forward and released from the helix after a predetermined rotation of the helix. One of such patents is disclosed in U.S. Pat. No. 3,335,907. This patent is rotated from the rear thereof and it rests on a tray at the front thereof. The articles to be dispensed rest upon a horizontally disposed platform within the helix.

It has been found that the helix, if connected at only one end thereof, will tend to compress when rotated, thereby creating some problems of dependably dispensing the items.

U.S. Pat. No. 3,601,281 shows a helix driven by a shaft which runs down the center of the helix, which shaft is an integral part of the helix. This helix is not, however, supported at the rear end thereof. A horizontal tray is disposed down the center of the helix in this last mentioned patent and the presence of this tray tends to stabilize the helix as it rotates.

U.S. Pat. No. 3,828,971 shows a helical member which is rotated from the rear thereof and this patent has a vertical divider disposed within the helical member. U.S. Pat. No. 3,861,561 shows a helical dispensing member which is driven by a central shaft, and this helical member is also supported along the top thereof by a vertical divider disposed within the helix.

In those vending machines having a horizontal tray disposed within a helical member, the normal manner of loading these machines is to have a side access from only one side thereof. This is highly desirable because these units can be stacked one on top of the other and then the whole stack of units can be pulled out of the vending machine housing and loaded from the one open side.

Of those vending machines which have a vertical divider such as shown in U.S. Pat. Nos. 3,828,971 and 3,861,561, it is necessary to either have access to both sides of the helix, or it is necessary to have access to the top thereof, in order to be able to place items to be vended on both sides of such vertical divider. It can be appreciated that if sides were not provided for the vending chamber that upon rotation, the items to be vended would probably be dislodged from their position within the coils of the helix and would not move forward in a desirable fashion.

Accordingly, there is a problem of how to load a vending apparatus using a helical drive member and having a vertical divider, while still providing sides for the vending chamber within which the helical member is disposed.

There exists also a problem of how to best support a helical member within a vending chamber such that it will not compress or flex excessively. This problem is very closely associated with the manner of turning the helix and the construction of those members which contact the helix.

SUMMARY OF THE INVENTION

The present invention relates to a helical vending apparatus having a vending chamber with a helical member disposed therein. The helical member is driven by a novel gear arrangement at the rear end of the helix, and the helix is supported at the other end thereof by an extension of the helix which is aligned with the longitudinal axis of the helix, which extension is attached to a tray or divider disposed within the helix. The vending chamber within which the helical member is disposed has sides which are movable from a vertical dispensing position to a non-vertical loading position. A plurality of such vending devices are stacked one on top of another and such plurality of stacked vending devices are slidably received within a vending machine housing.

An object of the present invention is to provide a dependable drive apparatus for a helical vending device.

Another object of the invention is to provide a supporting apparatus for a helical vending device which prevents the helical member from compressing or flexing excessively.

A further object of the invention is to provide a vending chamber for a helical member which has sides which are selectively vertical for maintaining the items to be dispensed in their proper place or selectively non-vertical for providing access to the sides of the helix for loading.

Still another object of the invention is to provide a side loading eature for a vending machine such that a plurality of vending devices can be stacked one on top of another and such plurality of vending devices being slidably receivable as a unit into and out from a vending machine housing.

Other objects, advantages and novel features of the present invention will become apparent from the following detailed description of the invention when considered in conjunction with the accompanying drawings.

DESCRIPTION OF THE PREFERRED EMBODIMENT

Figures 1, 2, 3, 4, 5:
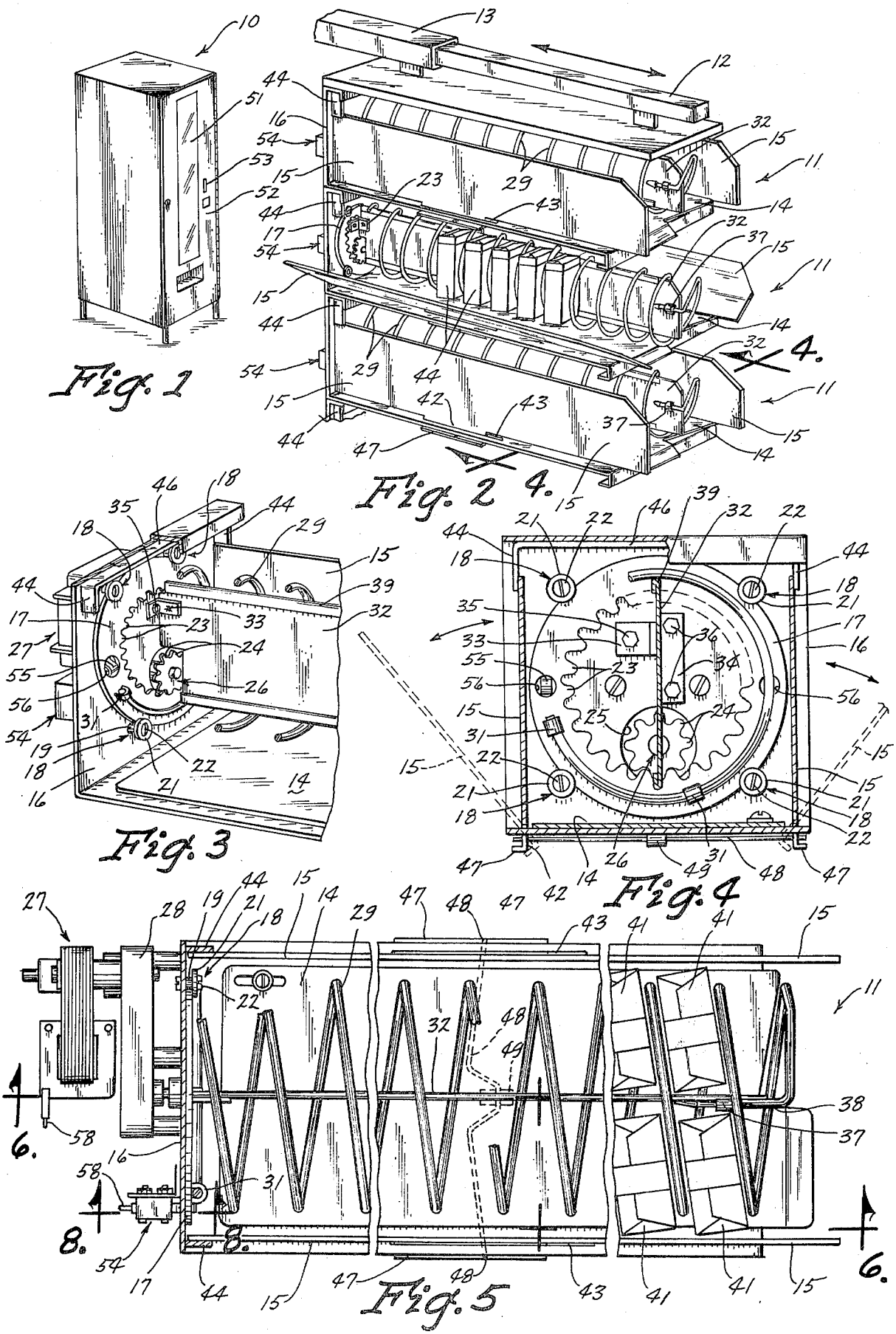
FIG. 1 is a perspective view of a vending machine housing according to the present invention.
FIG. 2 is a perspective view of the vending apparatus to be disposed within the housing of FIG. 1.
FIG. 3 is a partial perspective view of the driving apparatus for the helix of the present invention.
FIG. 4 is a partial cross-sectional view taken along line 4—4 of FIG. 2.
FIG. 5 is a cross-sectional view of the present invention looking from the top of the vending chamber.

Referring now to the drawings wherein like reference numerals designate identical or corresponding parts throughout the several views, FIG. 1 shows a vending machine 10 constructed according to the present invention. FIG. 2 shows a plurality of vending devices 11 stacked one on top of another and connected together. These vending devices 11 are slidable as a unit from a vending position within the vending machine housing 10 to a position outside of the vending machine housing 10 for loading. This sliding movement is accomplished manually, for example, by utilizing a bar 12 which is attached to the plurality of vending devices 11 and which bar 12 is slidably received within a member 13 which is, in turn, rigidly attached to the top interior of the vending machine housing 10.

Each of the vending devices 11 has a vending chamber which is formed by a floor 14, side walls 15 and an end wall 16. The floor 14 is shown to be in two pieces, but this two-piece construction forms no part of the present invention, although it is important for the reasons outlined in U.S. Pat. No. 3,861,561.

A plate 17 is rotatably attached to the end wall 16 by means of four projections 18 which are rigidly attached to the end wall 16. It can be clearly seen in FIGS. 3 and 4, for example, that these projections 18 have a smaller diameter portion 19 closest to the end wall 16 and a larger diameter portion 21 further from the end wall 16. A nut and bolt device 22 secures the projection 18 to the wall 16. This securing function may be such that the projection 18 can rotate about the bolt or screw device 22 or, alternatively, that it is fixed with respect to the bolt or screw device 22. These four projections 18, do however securely hold the plate 17 but yet allow it to rotate with respect to the end wall 16.

Figure 6:
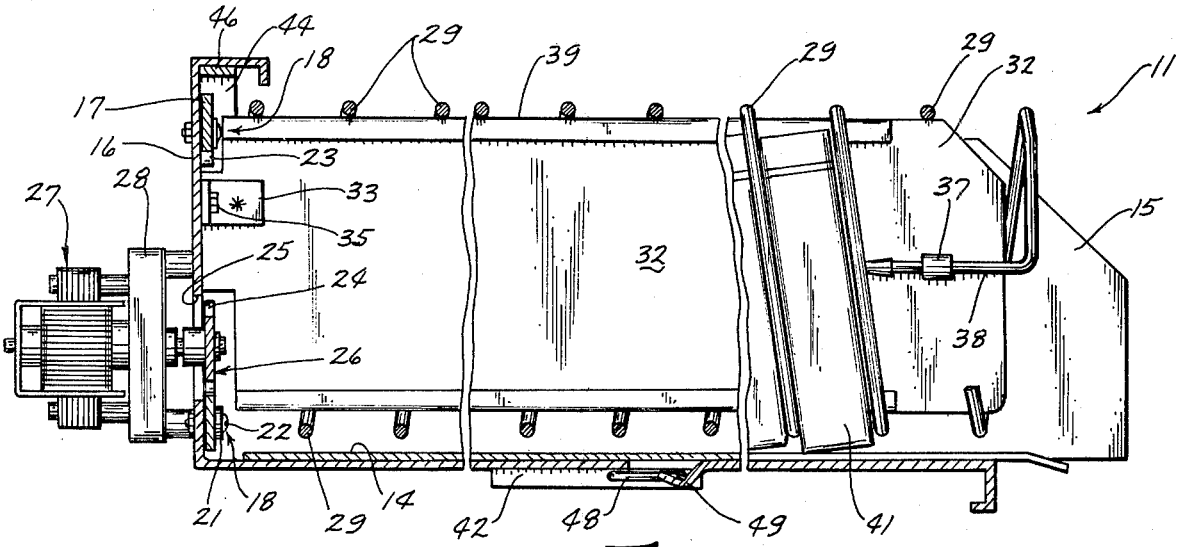
FIG. 6 is a partial cross-sectional view taken along line 6—6 of FIG. 5.

A plurality of gear teeth 23 are disposed around the inner periphery of the plate 17. These teeth 23 mesh with the teeth 24 on the drive gear 26 which extends through an opening 25 in the end wall 16. This drive gear 26 is driven by a motor 27 (FIGS. 5 and 6) through a gear box arrangement 28. It will be clearly understood to those skilled in this art that the motor 27 can directly drive the gear 26, or alternatively, other means can be provided for rotating the gear 26 as desired.

A helical member 29 is secured to the plate 17 by means of a pair of U-shaped members 31. Other equivalent ways of connecting the helical member 29 to the plate 17 would, of course, suggest themselves to those skilled in this art.

A vertical divider 32 is disposed centrally of the helical member 29 as can clearly be seen in FIGS. 2–4, for example. The vertical divider 32 is rigidly connected to the end wall 16 by means of a pair of brackets 33 and 34 which are secured by bolts 35 and 36 respectively to the end wall 16. At the other end of the vertical divider 32 is a journaling portion 37 which is punched out for reception of a straight portion 38 of the helix 29. This straight portion 38 is aligned with the longitudinal axis of the helical member 29 and rotates when the helical member 29 rotates. The helical member 29 rotates about the vertical divider 32 and the helical member 29 rests upon the top 39 (FIG. 4) of the vertical divider 32 to provide support for the helical member 29. Additionally, the straight portion 38 of the helical member 29 is journaled within the pushed out portion 37 of the vertical divider 32. It is the combination of the connection of the helical member 29 to the plate 17, the fact that the helical member 29 rests upon the top 39 of the vertical divider 32 and because the straight portion 38 of the helical member 29 is journaled in the vertical divider 32 that the helical member 29 is very stable and does not vibrate excessively when rotated.

Figure 7:
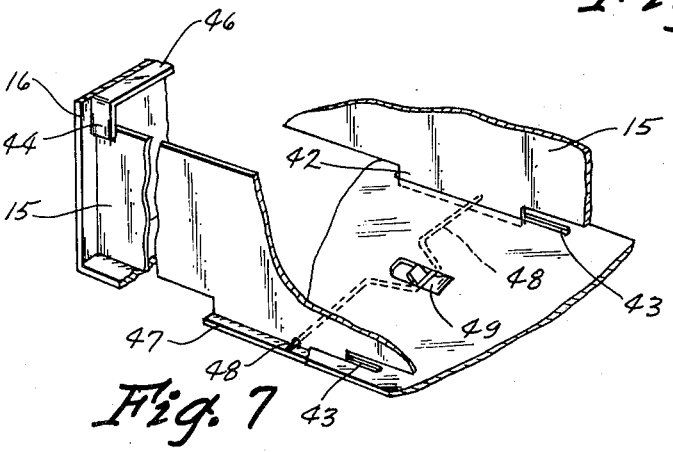
FIG. 7 is a partial cross-sectional view showing the operation of the sides of the vending chamber.

The side walls 15 are movable from the position shown on the top vending device 11 in FIG. 2 to the position shown in the middle vending device 11 in FIG. 2. When it is desired to load the items 41, such as packages of cigarettes, (FIG. 2), the front door 52 of the vending machine housing shown in FIG. 1 would be opened and the plurality of stacked vending devices 11 shown in FIG. 2 would be pulled straight forwardly such that they are suspended from the shaft 12 in front of the vending machine housing 10. At such time each individual side wall 15 is grasped manually and pulled in a direction away from the end wall 16. This movement is possible because of a projection 42 which extends through an opening 43 in the floor 14 (FIG. 7). The slot 43 is just long enough to allow the side wall 15 to move past the locking member 44 which is rigidly attached to the end wall 16 by means of a bar 46. Once this movement is accomplished, the shelf 15 will move from the position as shown in solid lines in FIG. 4 to the position as shown in dashed lines in FIG. 4.

A right angle bend portion 47 is formed on the projection 42 of the side wall 15 so as to prevent the side wall 15 from being easily dislodged from the slot 43. When the side walls 15 are in the non-vertical position as shown in dashed lines in FIG. 4, the items 41 to be vended can be easily placed on each side of the helical member 29, for example, as shown in FIG. 2. After each of the vending devices 11 has been filled, the sides 15 are moved to the vertical position again by pulling the side walls 15, again, away from the end wall 16 and past the locking device 44. Then the side wall 15 is manually moved to the vertical position and then slowly released such that the spring member 48 can move the side wall 15 back against the end wall 16 so that it is held in a vertical position by the locking structure 44 and by the spring 48.

The spring wire structure 48 is attached to the bottom center of the floor 14 by a punched-out portion 49. This punched -out portion 49 holds the center of the spring member 48 to the floor 14 and the spring member 48 extends through a hole in each of the projections 42 of each side wall 15. The purpose of this spring 48 is to bias the side wall 15 against the end wall 16 so that when the side wall 15 is in a vertical position, it will be so held by the locking structure 44 (FIG. 7).

Figure 8:
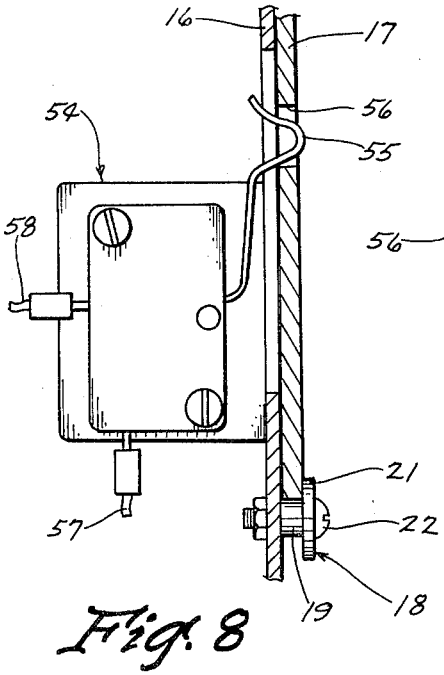
FIG. 8 is a cross-sectional view taken along line 8—8 of FIG. 5 and showing the switch of the present invention.
Figure 9:
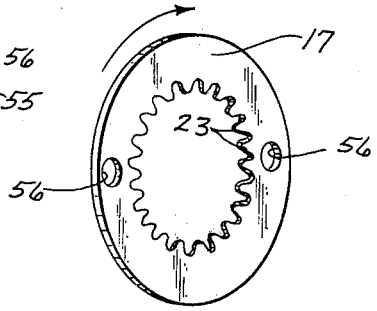
FIG. 9 is a perspective view of the annular plate which serves as part of the driving mechanism for the helix and which also cooperates with the switch for turning off the motor driving the present apparatus.

In order for a consumer to utilize the present invention such consumer would view the items in the vending machine housing 10 through a window 51 in the front door 52. Once the consumer has selected a particular vending device item desired, he would place an appropriate amount of money in coins within the slot 53 and then depress the proper buttons (not shown), as is well known. Once this has been done, a mechanism (not shown) will activate the electric motor 27 through a switch 54. Once this last step has been accomplished, the motor will rotate the gear 26 and thereby rotate the plate 17 and ultimately the helical member 29. This rotation will cause the spring member 55 (FIG. 8) to be moved from the first opening 56 in the plate 17. The rotation of the gear 26, plate 17 and helix 29 will continue until such time that the other opening 56 in the plate 17 is moved around by such rotation to the point that the spring member 55 drops into such other opening 56 in the plate 17. When this happens, the switch 54 turns off the motor 27, but not before causing one of the items 41 to be moved forward and thereby dispensed from the machine by the action of the one-half of a rotation of the helical member 29.

Accordingly, it can be seen that the preferred embodiment disclosed above does not indeed accomplish the objects set forth above. Obviously, many modifications and variations of the present invention are possible in light of the above teachings. It is therefore to be understood that, within the scope of the appended claims, the invention may be practiced otherwise than as specifically described.

I claim:

1. A vending apparatus comprising:

a housing;

means connected to said housing forming an item vending chamber, said means having a floor, at least one sidewall and at lease one end wall;

plate means rotatably mounted to said end wall, said plate means including an annular plate having a plurality of teeth disposed about the inner periphery thereof;

a substantially helical member disposed within said chamber and having a helical portion of one end thereof connected to said plate means;

a divider partition disposed within said helical member and being fixed with respect to said end wall;

the other end of the helical member having a portion thereof which is aligned generally with the longitudinal axis of said helical member and wherein said portion is rotatably connected to said divider partition; and means mounted within the housing for rotating said plate means and thereby said helical member, said means for rotating said plate means including a drive gear having teeth disposed on the outer periphery thereof, said drive gear being disposed within said annular plate whereby the teeth on the drive gear engage the teeth on said plate thereby rotating the plate when the drive gear is rotated.

2. A vending apparatus as defined in claim 1 wherein said divider portion is rigidly connected to said end wall.

3. A vending apparatus as defined in claim 1 wherein said divider partition is vertically disposed.

4. A vending apparatus as defined in claim 3 wherein the top edge of said divider partition is contiguous with the top of the inner periphery of said helical member.

5. A vending apparatus as defined in claim 1 wherein said at least one sidewall is pivotally attached to said floor.

6. A vending apparatus as defined in claim 5 wherein said sidewall has a vertical position and a non-vertical position.

7. A vending apparatus as defined in claim 6 including means for selectively holding said sidewall in said non-vertical position.

8. A vending apparatus as defined in claim 6 including means for selectively holding said sidewall in said vertical position.

9. A vending apparatus as defined in claim 5 wherein a second sidewall is pivotally connected to the floor.

10. A vending apparatus as defined in claim 9 wherein said second sidewall has a vertical position and a non-vertical position.

11. A vending apparatus as defined in claim 10 including means for selectively holding said second sidewall in said non-vertical position.

12. A vending apparatus as defined in claim 10 including means for selectively holding said second sidewall in said vertical position.

13. A vending apparatus as defined in claim 12 wherein said holding means for said second sidewall comprises:

a longitudinal slot formed in said floor;

a portion of said sidewall extending through said floor, said portion being slideable from a first to a second longitudinal position with respect to said floor;

a projection means fixed with respect to said end wall said projection being in abutment with said projection when said sidewall is in said vertical and said first longitudinal positions to thereby hold the sidewall in said vertical position and said sidewall being in a non-abutting relationship with the projection in said second longitudinal position and in said non-vertical position of the sidewall.

14. A vending apparatus as defined in claim 13 including means for biasing said second sidewall to said first longitudinal position.

15. A vending apparatus as defined in claim 5 wherein said means forming the item vending chamber is slidably mounted to the housing and is movable from a position within the housing to a position substantially outside of said housing.

16. A vending apparatus comprising:

a housing;

means connected to said housing forming an item vending chamber, said means having a floor, at least one sidewall and at least one end wall;

plate means rotatably mounted to said end wall;

a substantially helical member disposed within said chamber and having a helical portion of one end thereof connected to said plate means; and means mounted within the housing for rotating said plate means and thereby said helical member, said means for rotating said plate means including teeth on said plate and a drive gear meshing with said teeth, said plate means being generally annular, said teeth being disposed about the inner periphery thereof and said drive gear being disposed within said inner periphery.

17. A vending apparatus as defined in claim 16 wherein a motor is operably connected to said drive gear for selectively rotating said drive gear and therefore ultimately said helical member.

18. A vending apparatus as defined in claim 17 wherein said plate means includes:

at least one substantially flat side having at least one depression therein, said substantially flat side lying substantially in a plane normal to the axis of rotation of said plate means; and switch means being operatively attached to said end wall in abutment with said flat wall of said plate means for turning off said motor when said switch means is aligned with said depression.

19. A vending apparatus as defined in claim 18 wherein said switch means is operative to turn off said motor after each one half revolution.

20. A vending apparatus as defined in claim 19 wherein a second depression is formed in said plate means at a position 180° from the position of the first said depression.

21. A vending apparatus comprising:
a housing;
means connected to the housing for forming an item vending chamber, said means having a floor and at least one sidewall;
means for moving said sidewall from a substantially vertical position to a substantially non-vertical position whereby access is allowed to said chamber;
means for selectively locking said sidewall in said substantially vertical position;
means for selectively holding said sidewall in said non-vertical position, said holding means comprising:
a longitudinal slot formed in said floor;
a portion of said sidewall extending through said floor, said portion being slidable from a first to a second longitudinal position with respect to said floor;
a projection means fixed with respect to said end wall said projection being in abutment with said projection when said sidewall is in said vertical and said first longitudinal positions to thereby hold the sidewall in said vertical position and said sidewall being in a non-abutting relationship with the projection in said second longitudinal position and in said non-vertical position of the sidewall;
a substantially helical member disposed within said chamber; and
means mounted within said housing for selectively rotating said helical member about its longitudinal axis.

22. A vending appratus as defined in claim 21 wherein said sidewall is pivotally attached to said floor.

23. A vending apparatus as defined in claim 21 including means for biasing said sidewall to said first longitudinal position.

24. A vending apparatus as defined in claim 23 wherein said biasing means comprises a spring member connected to the floor and to the projection means.

25. A vending apparatus as defined in claim 24 wherein said projection means includes a portion which is disposed at an angle with respect to the sidewall.

26. A vending apparatus as defined in claim 22 wherein a second sidewall is pivotally connected to the floor.

27. A vending apparatus as defined in claim 26 wherein said second sidewall has a vertical position and a non-vertical position.

28. A vending apparatus as defined in claim 27 including means for selectively holding said second sidewall in said non-vertical position.

29. A vending apparatus as defined in claim 27 including means for selectively holding said second sidewall in said vertical position.

30. A vending apparatus as defined in claim 28 wherein said holding means for said second sidewall comprises:
a longitudinal slot formed in said floor;
a portion of said sidewall extending through said floor, said portion being slidable from a first to a second longitudinal position with respect to said floor;
a projection means fixed with respect to said end wall said projection being in abutment with said projection when said sidewall is in said vertical and said first longitudinal positions to thereby hold the sidewall in said vertical position and said sidewall being in a non-abutting relationship with the projection in said second longitudinal position and in said non-vertical position of the sidewall.

31. A vending apparatus as defined in claim 21 including means for biasing said second sidewall to said first longitudinal position.

32. A vending apparatus as defined in claim 21 wherein said means forming the item vending chamber is slidably mounted to the housing and is movable from a position within the housing to a position substantially outside of said housing.

33. A vending apparatus as defined in claim 21 wherein said means forming a chamber includes at least one end wall and a divider partition is disposed within said helical member, said divider partition being fixed with respect to said end wall.

34. A vending apparatus as defined in claim 33 wherein said divider partition is rigidly connected to said end wall.

35. A vending apparatus as defined in claim 33 wherein said divider partition is vertically disposed.

36. A vending apparatus as defined in claim 35 wherein the top edge of said divider partition is contiguous with the top of the inner periphery of said helical member.

37. A vending apparatus as defined in claim 33 wherein the other end of the helical member has a portion thereof which is aligned generally with the longitudinal axis of said helical member and wherein said portion is rotatably connected to said divider partition.

38. A vending apparatus as defined in claim 33 wherein said means for rotating said helical member includes a plate means rotatably mounted to said end wall including teeth on said plate means and a drive gear meshing with said teeth.

39. A vending apparatus as defined in claim 38 wherein said plate means is generally annular, said teeth are disposed about the inner periphery thereof and the drive gear is disposed within said inner periphery.

40. A vending apparatus as defined in claim 38 wherein a motor is operably connected to said drive gear for selectively rotating said drive gear and therefore ultimately said helical member.

41. A vending apparatus as defined in claim 40 wherein said plate means includes at least one depression therein and switch means being operatively attached to said end wall in abutment with said plate means for turning off said motor when said switch means is aligned with said depression.

42. A vending apparatus as defined in claim 41 wherein said switch means is operative to turn off said motor after each one half revolution.

43. A vending apparatus as defined in claim 42 wherein a second depression is formed in said plate means at a position 180° from the position of the first said depression.

44. A vending apparatus comprising;
a housing;
means connected to said housing forming an item vending chamber, said means having a floor, at least one sidewall pivotally attached to said floor and at least one end wall, said sidewall having a vertical position and a non-vertical position;
means for selectively holding said sidewall in said non-vertical position;

means for selectively holding said sidewall in said vertical position, said holding means comprising:

a longitudinal slot formed in said floor;

a portion of said sidewall extending through said floor, said portion being slidable from a first to a second longitudinal position with respect to said floor;

a projection means fixed with respect to said end wall said projection being in abutment with said projection when said sidewall is in said vertical and said first longitudinal positions to thereby hold the sidewall in said vertical position and said sidewall being in a non-abutting relationship with the projection in said second longitudinal position and in said non-vertical position of the sidewall;

plate means rotatably mounted to said end wall;

a substantially helical member disposed within said chamber and having one end thereof connected to said plate means;

a divider partition disposed within said helical member and being fixed with respect to said end wall;

the other end of the helical member having a portion thereof which is aligned generally with the longitudinal axis of said helical member and wherein said portion is rotatably connected to said divider partition; and means mounted within the housing for rotating said plate means and thereby said helical member.

45. A vending apparatus as defined in claim 44 including means for biasing said sidewall to said first longitudinal position.

46. A vending apparatus as defined in claim 45 wherein said biasing means comprises a spring ember connected to the floor and to the projection means.

47. A vending apparatus as defined in claim 46 wherein said projection means includes a portion which is disposed at an angle with respect to the sidewall.

* * * * *